US008234755B1

(12) United States Patent
Brand et al.

(10) Patent No.: US 8,234,755 B1
(45) Date of Patent: Aug. 7, 2012

(54) ADJUSTABLE EXTENSION FOR HANDLES

(75) Inventors: Kolman Brand, Longwood, FL (US); Cristian A. Santizo, Longwood, FL (US)

(73) Assignee: Kolman Brand, Longwood, FL (US)

( * ) Notice: Subject to any disclaimer, the term of this patent is extended or adjusted under 35 U.S.C. 154(b) by 519 days.

(21) Appl. No.: 12/589,290

(22) Filed: Oct. 21, 2009

(51) Int. Cl.
*B25G 1/04* (2006.01)

(52) U.S. Cl. ..... 16/427; 16/113.1; 16/405; 16/429

(58) Field of Classification Search ..... 16/113.1, 16/405, 427, 429; 15/143.1–144.4, 410; 81/177.2; 294/210; 403/109.1–109.3, 109.6, 403/190.8, 378; 280/87.05, 47.315, 47.371, 280/638, 655, 655.1
See application file for complete search history.

(56) References Cited

U.S. PATENT DOCUMENTS 3,955,511 A 5/1976 Bak
3,980,805 A * 9/1976 Lipari ..... 174/88 C
4,094,330 A 6/1978 Jong
4,392,538 A 7/1983 Goertzen
5,044,650 A * 9/1991 Eberle, Jr. ..... 280/304.1
5,290,055 A * 3/1994 Treat, Jr. ..... 280/304.1
5,553,350 A * 9/1996 Chang ..... 16/113.1
5,806,143 A * 9/1998 Tsai ..... 16/405
5,915,712 A * 6/1999 Stephenson et al. ..... 280/304.1
6,101,678 A * 8/2000 Malloy et al. ..... 16/438
6,301,749 B1 * 10/2001 Chen ..... 16/429
7,182,179 B2 2/2007 Tolfsen
7,226,396 B2 6/2007 Buechel, Jr.
7,373,708 B2 * 5/2008 Stahle et al. ..... 29/434
2003/0000785 A1 1/2003 Miller
2003/0137119 A1 7/2003 Razon
2005/0023781 A1 2/2005 Ortega
2005/0076939 A1 4/2005 Karasin
2007/0024029 A1 2/2007 Dotsey

* cited by examiner

*Primary Examiner* — Victor Batson
*Assistant Examiner* — Roberta Delisle
(74) *Attorney, Agent, or Firm* — Kenneth F. Pearce

(57) ABSTRACT

The present invention relates to an extension for handles of an existing device. In accordance with the current invention, extensions can be connected to the handles and securely adjusted in both generally vertical and generally horizontal directions. Extensions of the current invention are particularly well-suited for use with the handles of rollable devices.

14 Claims, 5 Drawing Sheets

ADJUSTABLE EXTENSION FOR HANDLES

BACKGROUND OF THE INVENTION

1. Field of the Invention

In the most general sense, the present invention relates to an extension for handles of an existing device. The extension can be easily and securely connected to the handles. Depending on the requirements of the user, the extension can be securely adjusted in both generally vertical and generally horizontal directions. And for select preferred embodiments, the extension is particularly well-suited for use with the handles of a rollable apparatus.

2. Description of the Previous Art

1) U.S. Pat. No. 3,955,511-Bak enables an adjustable stand for appliances. Column 2, in part, reads: "The length of each rectangular frame member 20 and 22 is adjustable by means of telescoping portions in the upper and lower horizontal beams, 24 and 26, of each. For example, as shown in FIGS. 2 and 3, the rectangular frame member 20 comprises two relatively movable portions connected together by sliding telescoping sections indicated at 28 and 30 in the respective upper and lower beams 24 and 26 thereof. The telescoping sections 28 and 30 each comprise a length of reduced diameter tubing projecting from one portion and extending into and slidably received by the open tube end in the other portion.

It will be appreciated that the portions of reduced diameter comprising the telescoping sections 28 and 30 may be coextensive with the entire length of the beams 24 and 26; hence, an increase in length of each frame member 20 and 22 to slightly less than twice the original length is possible. In addition, a series of alignable apertures 32 may be provided through the telescoping sections 28 and 30 to allow insertion of a suitable retainer or stop, such as a pin 31 (FIG. 4) to hold the members in the desired adjusted position. It will be noted that the telescoping sections 28 and 30 are located adjacent one of the corners of the frame to provide better stability and are preferably located adjacent diagonally opposite corners as shown.

Upper and lower transverse horizontal tie rods 34 and 36 are provided at each end of the stand to connect the end members 10 and 12 and the rectangular frame members 20 and 22 together. As shown in FIGS. 2 and 5, the tie rods 34 and 36 extend through apertures in corresponding corners of the frame members 20 and 22 and through aligned apertures in the vertical portions of the end members 10 and 12. The rods 34 and 36 are restrained against axial movement by means of a suitable head 38 at one end and a suitable nut 40 or other removable retainer at the other end (FIG. 5).

In addition, one or more intermediate adjustable longitudinal members 62 may be provided to span one or both of the upper or lower pairs of tie rods 34 and 36, as shown in FIGS. 2, 4 and 5. The intermediate member 62 has a downwardly facing recess 64 at each end thereof adapted to engage over the respective pairs of rods 34 or 36, and is therefore easily removed from and connected to the structure. The member 62 comprises a pair of tubular sections 64 and 66, one of which 66 has a portion of reduced diameter adapted to slidably telescope into the open end of the other section 64, whereby the composite member 62 is adjustable in length. The reduced diameter portion of section 66 has a series of apertures 68 therethrough alignable with an aperture 70 through section 64. In this manner, a suitable retainer or pin 72 (FIG. 4) may be inserted through the apertures at the desired length."

Bak teaches a cart that can be adjusted. However, the '511 patent does not disclose an extension for handles. Among other things, Bak does not disclose a connector, superior joints, inferior joints, shafts extending between the joints elements of Applicant's current invention or the capability of the invention to be adjusted with respect to the invention's width and height.

2) U.S. Pat. No. 4,094,330-Jong enables a walker. Column 3, in part, reads:

"Each of the leg length adjusting and extension elements 19 includes two telescopically interfitting upper and lower tubes 36 and 37 (FIG. 3). The upper tube 36 is desirably received within the lower tube 37, and is a close fit therein to provide together an essentially rigid leg assembly. Tube 37 has a series of vertically spaced identical apertures 38, within which a detent button 39 is selectively receivable. This detent button 39 is mounted within an aperture 40 in a side of tube 36 for movement essentially radially inwardly and outwardly along the axis represented at 41 in FIG. 3, with the button 39 being yieldingly urged outwardly by a leaf spring 42 contained within tube 36 and having a first arm 43 bearing against the left side of tube 36 in FIG. 3 and a second end 44 doubled back and carrying button 39 and urging it rightwardly. As will be understood, the button 39 is receivable within any of the different apertures 38, and is held in those apertures by spring 42, to lock tubes 36 and 37 in any set position, but with the button being adapted for release by pressing it inwardly (leftwardly in FIG. 3) to move the button out of a particular one of the circular openings 38 and enable relative longitudinal shifting movement of the tubes until the button falls into another of the openings.

At its lower end, tube 37 carries a conventional caster assembly 45, adapted to engage and roll along a floor surface, sidewalk, or the like 18. At its upper end, tube 36 carries a screw 46, having an enlarged lower head 47 which is received within the upper end of tube 36 and is suitably welded or otherwise rigidly secured thereto. The upwardly projecting reduced diameter shank 48 of screw 46 has external threads which may be fairly coarse to allow for substantial axial adjustment of the parts by virtue of this threaded connection. This threaded shank projects upwardly into a nut 49 which is contained within the lower tubular end of a corresponding leg portion 14 or 15 of one of the parts 13, and is welded or otherwise secured rigidly thereto. The internal threads 50 within nut 49 threadedly engage the threads of shank 48 to afford the desired vertical adjustment. A screw 51 is connected threadedly into the nut, along an axis 52 extending radially with respect to the main axis 53 of the leg, and is adapted to exert force against the shank 48 of the screw to lock it in a set position. This force may be transmitted to the screw through a cushion element 53 formed of leather or the like, for attaining a high frictional relationship with the screw while at the same time avoiding damage to it."

Jong teaches that the walker's frame is adjustable with respect to its height and width. However, the '330 patent does not disclose an extension for handles. Among other things, Jong does not disclose a connector, superior joints, inferior joints, shafts extending between the joints elements of Applicant's current invention or the capability of invention to be adjusted with respect to the invention's width and height.

3) U.S. Pat. No. 4,392,538-Goertzen enables an adjustable handle assembly for walk-behind garden implement. Columns 2 and 3, in part, read:

A walk-behind garden tiller of modern design, illustrated in FIGS. 1-3, includes a horizontal frame 10 supported upon a pair of ground-engaging drive wheels 11, 12. The frame supports an engine (not shown) enclosed within an engine housing 13. At the rear of the frame is a tine enclosure 14 containing a set of rotary tines (not shown) which are power driven through a transmission (not shown) enclosed within a transmission housing 15. Extending upwardly and rearwardly from the frame is a unitary handle 20 having a lower end 21 and an upper, or guiding, end 22. Rigidly secured to the upper end of the handle is a hand grip 23 formed of a tube bent into picture frame shape. Bridging the hand grip and pivoted to the sides thereof is a bail 25 which is connected by a cable 26 to a power control member, typically a clutch at the engine output so arranged that the clutch is engaged only during the time that the bail is actively gripped thereby providing what is generally referred to as "dead man" control. A shift lever 27 enables shifting of gears in the transmission.

Adjacent the shift lever is a knob 28 which, as will be described, is connected to a "Bowden" type flexible control cable which releases the handle for manual adjustment, with respect to the frame, to a more convenient elevation and lateral position, or azimuth. A total of nine possible positions have been illustrated at 29 in FIG. 3 and, depending upon the specific design, an even greater selection of positions is possible."

The '538 patent does not disclose an extension for handles. Among other things, Goertzen does not disclose a connector, superior joints, inferior joints, shafts extending between the joints elements of Applicant's current invention or the capability of invention to be adjusted with respect to the invention's width and height.

4) U.S. Pat. No. 7,182,179-Tolfsen enables a walker with adjustable handlebar. Column 3, in part, reads:

"The invention relates to a walker of which an embodiment is illustrated in a partly exploded view in FIG. 3, with main frame (1) shown in the FIGS. 1 a, 1 b, 2 a, and 2 b. The main frame (1) is oblique, almost vertical, and is retained in position by a horizontal transversally positioned beam (30) shown in FIG. 3. The walker is provided with a rear frame leg (4), one or more rear wheels (23) and one or more front wheels (23 B). The user holds and guides the walker by means of a handle bar (11). The walker is provided with a brake (22) which may be activated, tensioned and adjusted, directly or indirectly, by means of a brake bar (8), e.g., such as indicated on FIGS. 1 a to 2 b, through a brake handle bar (10) shown in FIG. 3. The brake (22) itself is shown schematically in FIGS. 1 a-2 b, as a rear brake being activated for braking the rotation of at least one of the rear wheels (23), or for blocking at least one of the rear wheels (23) from rotating.

The walker according to an embodiment of the invention comprises the following features:—a main frame (1) with a telescopic frame member (2) running generally in a vertical direction in the main frame (1). The height of the telescopic frame member (2) is slidably adjustable in relation to the main frame (1), and may be locked in the desired height by utilizing pins or screws or corresponding locking mechanism. The handle bar (11) (FIG. 3) is mounted near the top of the telescopic frame member (2). A brake handle (10), is also mounted near the top of the telescopic frame member (2). The brake handle may be pulled up or be pushed down to activate the brake (22) via the brake bar (8). It is also possible to arrange the brakes so that the brake bar (8), by being pulled up or pushed down deactivates the brake. In other words, when the brake handle bar (10) is not loaded, the brake is activated and the walker stands alone."

The '179 patent does not disclose an extension for handles. Among other things, Tolfsen does not disclose the connector, superior joints, inferior joints, shafts extending between the joints elements of Applicant's current invention or the capability of invention to be adjusted with respect to the invention's width and height.

5) U.S. Pat. No. 7,226,396-Buechel, Jr., et al. enables a rehabilitation and fitness trainer apparatus. Columns 4 and 5, in part, read:

"The bracket 16 is fixedly attached to the cross bar 14 by means of a plurality of fasteners 22. The bracket 16 is attached substantially in the center of the cross bar 14. This forms a symmetrical structure further increasing the overall stability of the apparatus 10. Extending vertically upward from the bracket 16 are a plurality of vertical members 18 formed from steel, aluminum or other suitable material for supporting the user's weight. These vertical members are tubular and may be rectangular, round, hexagonal or octagonal in shape. Preferably the vertical members 18, 18 are of a rectangular tubular construction and substantially parallel to one another. Furthermore, the vertical members 18, 18 are angled slightly in the rearward direction away from the wheels 26. The top of each vertical member 18 is open and a locking device 30 is disposed near the top of each vertical member 18. Each vertical member 18 has a pair of apertures 48 (see FIG. 5) that are circular and substantially parallel to each other so that a locking device 30 may be inserted therein. These apertures 48 are disposed near the top of the vertical member 18, on the sides of the vertical member 18 that are perpendicular to the cross bar 14. Also, the apertures 48 of each vertical member 18 are substantially parallel to the apertures 48 of the other vertical member 18 to maintain proper horizontal alignment of the handle 32. Attached to the base frame 46 is the mounting bracket 40 including the vertical members 18, 18 and attached to the upper portion of the mounting bracket 40 is the handle frame 32. The handle frame 32 includes cushioned grip portions 34, 34 and telescoping sections 20, 20. The telescoping sections 20, 20 are securably attached to the handle frame 32. The telescoping members 20 are formed in the same shape as the vertical members 18. Each telescoping member 20 may be either tubular or solid and manufactured from aluminum, steel or any other suitable structural material with the strength to support the user during the exercise routine."

The '396 patent does not disclose an extension for handles. Among other things, Buechel does not disclose the connector, superior joints, inferior joints, shafts extending between the joints elements of Applicant's current invention or the capability of invention to be adjusted with respect to the invention's width and height.

6) US Pub. Patent App. 20030000785-Miller, et al. discloses an adjustable handle system for a carrying case. Paragraph 21 reads:

"[0021] Operationally, the adjustable handle system 11 will typically be in a retracted position as shown in FIG. 2 and essentially be biased to remain in the retracted position until pulled up as shown in FIG. 3. Both "handles" will ideally be lined in parallel and recessed within the cavity 25. The cavity 25 is preferably within a recessed area that has opposing recessed areas 21 and 23 as shown to allow for easy access to the "handles". The cavity 25 may also include a rubber boot on the top periphery of the cavity that allows the handle to extend and retract, yet resists the intrusion of dust and possibly liquids. Once the handle is pulled up as shown in FIG. 3, the vertical members 15 will remain in place at a set height under tension or by some other suitable position setting mechanism. The adjustable handle further preferably comprises a locking mechanism having a button on a portion of the handle allowing a user to selective lock the handle in any one of a plurality of positions. In FIG. 3, locking mechanism is a button 27 on the horizontal portion allowing a user to selective lock the handle 13 in any one of a plurality of positions. Alternatively, the locking mechanism shown in FIG. 4 is a button 31 on the grasping bar 19 extending from the U-shaped portion 18. Additionally, the grasping bar 19 can have a gripping area 29 ergonomically formed for most hands. In one embodiment, the user can selectively lock the handle in one of three positions as the handle 19 pivots about joint 33 as shown in FIGS. 4 and 7."

The '785 Application does not disclose an extension for handles. Among other things, Miller does not disclose the connector, superior joints, inferior joints, shafts extending between the joints elements of Applicant's current invention or the capability of invention to be adjusted with respect to the invention's width and height.

7) US Pub. Patent App. 20030137119-Razon discloses an adjustable leg support and seated to stand up walker. Paragraph 30 reads:

"[0030] Refer now to FIG. 2 showing an isometric drawing of the preferred embodiment stand up walker of the present invention having two vertical front legs 25 and two vertical rear legs 26 and a pair of pivoting support arms 21 and 22. The support arms 21 and 22 are shown pivoting at the top of the legs 25 via pivots 23 and 24. The preloaded gas springs 27 are provided with piston rods 28 shown downwardly extending and connected to the legs 25 by lower connecters 31 and the gas cylinder is shown connected to the support arms 21 and 22 via upper connecters 29. It will be understood that the connecters 29 are moveable on the support arms so as to adjust the amount of supporting force applied by the gas springs 27. Further, the gas springs 27 may be reversed in their orientation so that the cylinder is at the lower most position. Further, it will be understood that the lower connecters 31 are preferably adjustable on the legs 25 so as to adjust the height and angle of the arms 21 and 22."

The '119 Application does not disclose an extension for handles. Among other things, Razon does not disclose the connector, superior joints, inferior joints, shafts extending between the joints elements of Applicant's current invention or the capability of invention to be adjusted with respect to the invention's width and height.

8) US Pub. Patent App. 20050023781-Ortega discloses a universal attachment structure. Paragraph 21 reads:

"Preferably, the handle 104 is extendable from the universal attachment structure 100. In one embodiment, the extension may occur outwardly, away from the universal attachment structure 100 in a generally horizontal direction. Alternatively, the extension may occur outwardly and away from the universal attachment structure 100 in a generally horizontal direction, as well as upwardly and away from the universal attachment structure 100 in a generally vertical direction. Extending the handle 104 in the horizontal direction provides added space for the golf bag and may allow for room between the golf bag and the universal attachment structure 100 for grasping the handle 104."

The '781 Application does not disclose an extension for handles. Among other things, Ortega does not disclose the connector, superior joints, inferior joints, shafts extending between the joints elements of Applicant's current invention or the capability of invention to be adjusted with respect to the invention's width and height.

9) US Pub. Patent App. 20050076939-Karasin, et al. discloses a walker. Paragraphs 37 and 42 read:

"A first pair of handles is attached to the frame at the upper end of each of the front vertical supports. Each of the first pair of handles extends rearward from the front vertical support to which it is attached and is positioned for grasping by a user while in an upright position. The first pair of handles may be permanently attached to the front vertical supports, or attached to allow for subsequent adjustment, removal and/or replacement. Adjustable handles may be provided with a mechanism, such as a lock or clamp that allows, restricts or prevents relative movement of the first pair of handles and the front vertical supports to which they are attached. Removable handles may be subsequently re-attached or replaced with other handles of the same type or handles of a different size, shape and/or material according to the needs of the user. In embodiments of the walker in which the front vertical supports comprise at least two sections, the first pair of handles is preferably positioned on the upper sections. In such embodiments, the height of the first pair of handles from the ground may be readily adjusted to accommodate differently-sized users by movement of only the upper sections of the front vertical supports rather than by adjustment of sections on all four vertical supports. FIGS. 1-5 and 7 show an embodiment of the walker with a first pair of handles 36 and 37 attached to the top end of front vertical supports 11 and 12.

An embodiment of the walker having the second pair of handles integral with the frame is shown in FIGS. 1-7. The second pair of handles 38 and 39 is spaced sufficiently from the first pair of handles 36 and 37 so as to avoid interference with use of the second pair of handles 38 and 39. The second pair of handles is located at a predetermined distance from glides 34 and 35 positioned at the bottom of rear vertical supports 14 and 15 so that the second pair of handles 38 and 39 is comfortably positioned for a seated user to grasp and use in raising himself or herself from a seated position, or in lowering himself or herself to a seated position. As shown in FIG. 4, the geometric centers of the second pair of handles 38 and 39 are positioned to the rear of the load-bearing axis of rear vertical supports 14 and 15. In this position, the handles are readily accessible to a seated person."

The '939 Application does not disclose an extension for handles. Among other things, Karasin does not disclose the connector, superior joints, inferior joints, shafts extending between the joints elements of Applicant's current invention or the capability of invention to be adjusted with respect to the invention's width and height.

10) US Pub. Patent App. 20070024029-Dotsey, et al. adjustable handle assembly. Paragraph 73 reads:

"The stroller 100 in this example also has a child's or occupant's tray 124 that extends across the frame assembly 102 above the seat 108 and forward of the seat back 106. The tray 124 can be configured to provide a surface or surfaces on which a child can place various types of objects. In this example, the tray 124 traverses the stroller between the front legs 121. The stroller 100 in this example also has a pair of "umbrella" type handles 126. A user will typically grasp the handles, one in each hand, in order to push, pull, and otherwise manipulate the stroller during normal use. Each handle 126 extends rearward from a rear frame extension 128, one on each frame side 102 a and 102 b. A joint structure 130 on each side of the stroller 100 joins and links the rear leg 123, front leg 121, and rear frame extension 128 of each frame side 102 a and 102 b. The rear frame extensions 128 extend rearward and upward from the joint structures 130 on the frame sides. An upper end 132 of the front leg 121 and an upper end 134 of the rear leg 123 extend up to the joint structures 130 on each frame side 102 a and 102 b in the disclosed stroller."

The '029 Application does not disclose an extension for handles. Among other things, Dotsey does not disclose the connector, superior joints, inferior joints, shafts extending between the joints elements of Applicant's current invention or the capability of invention to be adjusted with respect to the invention's width and height.

SUMMARY OF THE INVENTION

Among other things, the current extension is attachable to the handles of a plurality of devices, such as walkers, baby carriages, hand trucks, etc. Prior to the current invention, it is believed that previously available extensions for handles were not concurrently adjustable in both generally vertical and horizontal directions.

An aspect the present invention is to provide an extension that is connectable with handles of a plurality of devices.

It is another aspect of the present invention is to an extension that is connectable with handles of a plurality of rollable devices having at least two wheels.

Still another aspect of the present invention is to provide an extension for handles that includes one or more members rotatable about a generally vertical or generally horizontal direction.

Yet another aspect of the present invention is to provide an extension for handles that is simultaneously adjustable with respect to the extension's height and width.

Still another aspect of the present invention is to provide an extension for handles that is selectively and securely adjustable relative to the physique of the user.

It is another aspect of the present invention to provide an extension that is easily, quickly and securely adjustable relative to the extension's height and width.

Yet another aspect of the present invention is to provide fasteners that allow the extension for handles to be easily and quickly secured to the handles.

An embodiment of the present invention can be described as an adjustable extension for a pair of handles of a rollable apparatus; the adjustable extension comprising: a) a first adjustable tubular elbow-like connector comprising: i) an opening at each end thereof; ii) a generally horizontal member rotatable through a generally horizontal plane capable of connection to a first handle of the rollable apparatus; iii) a generally vertical member integral with the generally horizontal member; and iv) one or more holes about the first connector's sidewall; b) a first fastener for securing the first adjustable tubular elbow-like connector to the first handle; c) a first generally vertical tubular receiver securable within the first adjustable tubular elbow-like connector's vertical member; the first generally vertical tubular receiver comprising one or more openings about the first vertical receiver's sidewall; d) a first adjustable tubular elbow-like handgrip, superior to the first adjustable tubular elbow connector, the first adjustable tubular elbow comprising: i) an opening at each end thereof; ii) a generally vertical member; iii) a generally horizontal member integral with the generally vertical member; and iv) one or more holes about the first handgrip's sidewall; e) a second generally vertical tubular receiver securable within the first adjustable tubular elbow-like handgrip's vertical member; the second generally vertical tubular receiver comprising one or more openings about the second vertical receiver's sidewall; f) a first generally horizontal tubular receiver securable within the first adjustable tubular elbow-like handgrip's horizontal member; the first generally horizontal tubular receiver comprising one or more openings about the first horizontal receiver's sidewall; g) a second adjustable tubular elbow-like connector comprising: i) an opening at each end thereof; ii) a generally horizontal member rotatable through a generally horizontal plane capable of connection to a second handle of the rollable apparatus; iii) a generally vertical member integral with the first generally horizontal member; and iv) one or more holes about the second connector's sidewall; h) a second fastener for securing the second adjustable tubular elbow-like connector to the second handle; i) a third generally vertical tubular receiver securable within the second adjustable tubular elbow-like connector's vertical member; the third generally vertical tubular receiver comprising one or more openings about the third vertical receiver's sidewall; j) a second adjustable tubular elbow-like handgrip, superior to the second adjustable tubular elbow connector, the second adjustable tubular elbow comprising: i) an opening at each end thereof; ii) a generally vertical member; iii) a generally horizontal member integral with the generally vertical member; and iv) one or more holes about the second handgrip's sidewall; k) a fourth generally vertical tubular receiver securable within the second adjustable tubular elbow-like handgrip's vertical member; the fourth generally vertical tubular receiver comprising one or more openings about the fourth vertical receiver's sidewall; l) a second generally horizontal tubular receiver securable within the second adjustable tubular elbow-like handgrip's horizontal member; the second generally horizontal tubular receiver comprising one or more openings about the second horizontal receiver's sidewall; m) a first generally vertical tube-like member comprising one or more openings about the first vertical tube-like member's sidewall; the first generally vertical tube-like member securable within the first generally vertical tubular receiver and the second generally vertical tubular receiver; n) a second generally vertical tube-like member comprising one or more openings about the second vertical tube-like member's sidewall; the second generally vertical tube-like member securable within the third generally vertical tubular receiver and the fourth generally vertical tubular receiver; o) a generally horizontal tube-like member comprising one or more openings about the generally horizontal tube-like member's sidewall; the generally horizontal tube-like member securable within the first generally horizontal tubular receiver and the second generally horizontal tubular receiver; and p) a plurality of third fasteners engaging one or more of said holes and the openings for providing secure and selective adjustment of the adjustable extension.

Another embodiment of the present invention can be described as an extension for a pair of handles, comprising: a) a first shaft; b) a second shaft; c) a third shaft; d) a first inferior hollow elbow including one or more sidewall openings; the first inferior hollow elbow further comprising: a slidable hollow cylinder insertable into the first inferior hollow elbow and capable of riding along the first shaft, wherein the slidable hollow cylinder further comprises one or more circumferential holes; e) a second inferior hollow elbow including one or more sidewall openings; the second inferior hollow elbow further comprising: a slidable hollow cylinder insertable into the second end and capable of riding along the second shaft, wherein the slidable hollow cylinder further comprises one or more circumferential holes; f) fasteners for securing the inferior elbows to said handles; g) a first superior hollow elbow including one or more sidewall openings; the first superior hollow elbow further comprising: i) a first slidable ring insertable into a first end and slidable along the first shaft, wherein the first slidable ring further comprises one or more circumferential apertures; ii) a second slidable ring insertable into a second end and slidable along the third shaft, wherein the second slidable ring further comprises one or more circumferential apertures; h) a second superior hollow elbow including one or more sidewall openings; the second superior hollow elbow further comprising: i) a first slidable ring insertable into a first end and slidable along the second shaft, wherein the second slidable ring further comprises one or more circumferential apertures; ii) a second slidable ring insertable into a second end and slidable along the third shaft, wherein the second slidable ring further comprises one or more circumferential apertures; and i) a plurality of fasteners allowing selective horizontal and vertical adjustment of the extension.

Yet another embodiment of the present invention can be described as an extension for a pair of handles, comprising: a)

a pair of angular sleeves connectable to the handles; each angular sleeve comprising: i) a first end connectable to one of the handles; ii) a second end including a movable hollow cylinder; and iii) one or more sidewall openings; b) a pair of angular handgrips; each angular handgrip comprising: i) a first end tube adjustable within the first end; ii) a second end tube adjustable with the second end; and iii) one or more sidewall openings; c) shaft-like spans extending between: i) each moveable hollow cylinder and each adjustable first end tube; and ii) each adjustable second end tubes; and e) fasteners capable of securing the angular sleeves to the handles and allowing selective horizontal and vertical adjustments of the extension.

Still another embodiment of the present invention can be described as an extension for handles, wherein said extension is adjustable relative to the extension's width and height, the extension comprising: a) a first superior joint comprising first and second receiving ends; b) a first inferior joint comprising first and second receiving ends; c) a second superior joint comprising first and second receiving ends; d) a second inferior joint comprising first and second receiving ends; e) a first shaft connected with the first receiving end of the first superior joint and the second receiving end of the first inferior joint such that the first superior joint and the first inferior joint are capable of collapsing from an extended position to a contact position or extending from a contact position to an extended position; f) a second shaft connected with the first receiving end of the second superior joint and the second receiving end of the second inferior joint such that the second superior joint and the second inferior joint are capable of collapsing from an extended position to a contact position or extending from a contact position to an extended position; and g) a third shaft connected with the second receiving end of the first superior joint and the second receiving end of the second superior joint such that the first superior joint and said second superior joint are capable of collapsing from an extended position to a contact position or extending from a contact position to an extended position.

It is the novel and unique interaction of these simple elements which creates the methods, within the ambit of the present invention. Pursuant to Title 35 of the United States Code, descriptions of preferred embodiments follow. However, it is to be understood that the best mode enablement and descriptions do not limit the scope of the present invention.

DESCRIPTION OF THE PREFERRED EMBODIMENTS

Although the disclosure hereof is detailed to enable those skilled in the art to practice the invention, the embodiments published herein merely exemplify the present invention.

The current extension for handles is adjustable relative to both the extension's width and its height. Embodiments of the present extension are adaptable for use with devices having at least two handles, and are composed of durable plastics, lightweight metals or combinations thereof. The current invention incorporates specific embodiments particularly suited for use with the existing handles of apparatus that have at least two wheels, e.g., rollable devices such as walkers, baby carriages, hand trucks, etc.

Figure 1:
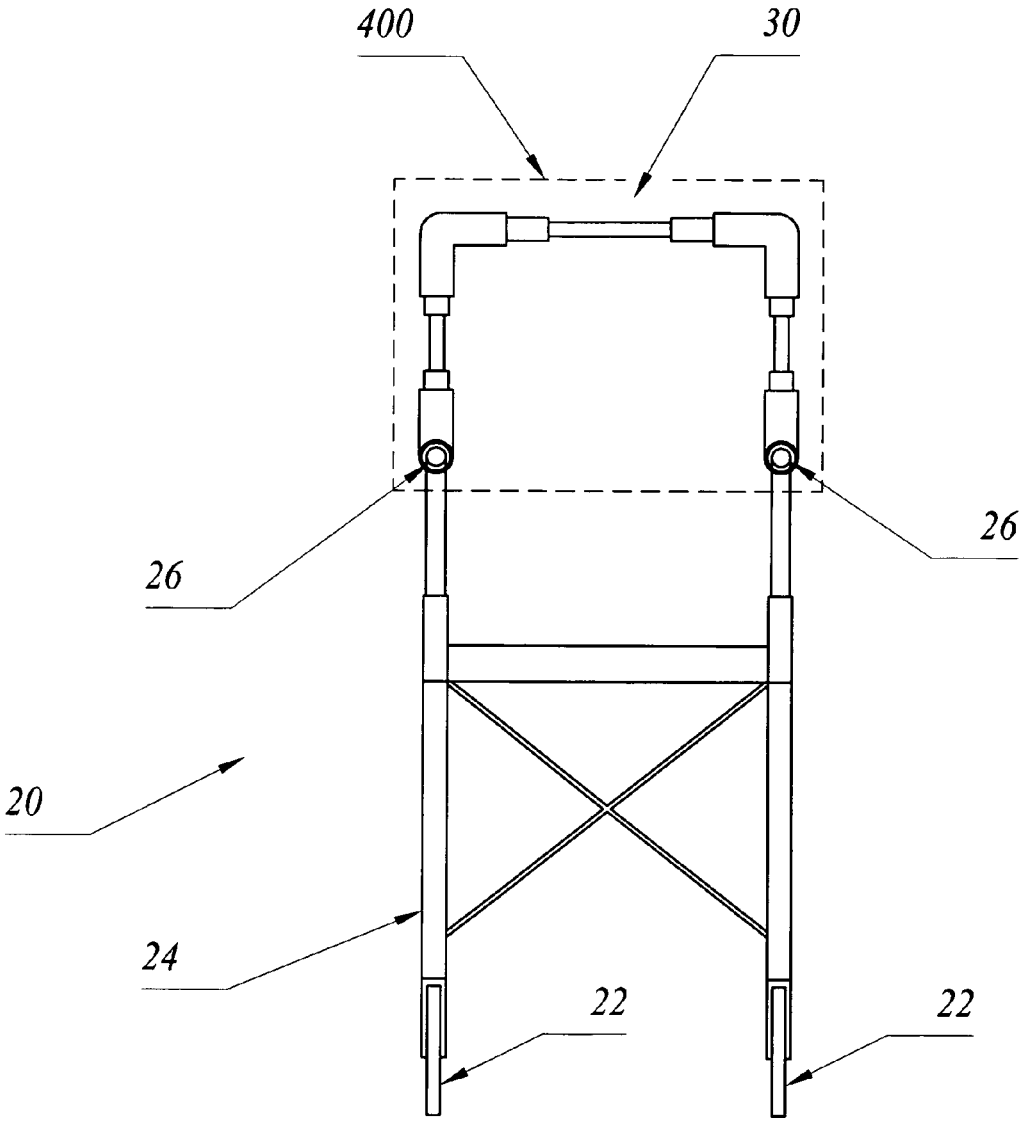
FIG. 1 is a rearward depiction of an apparatus having a pair of handles.
Figure 2:
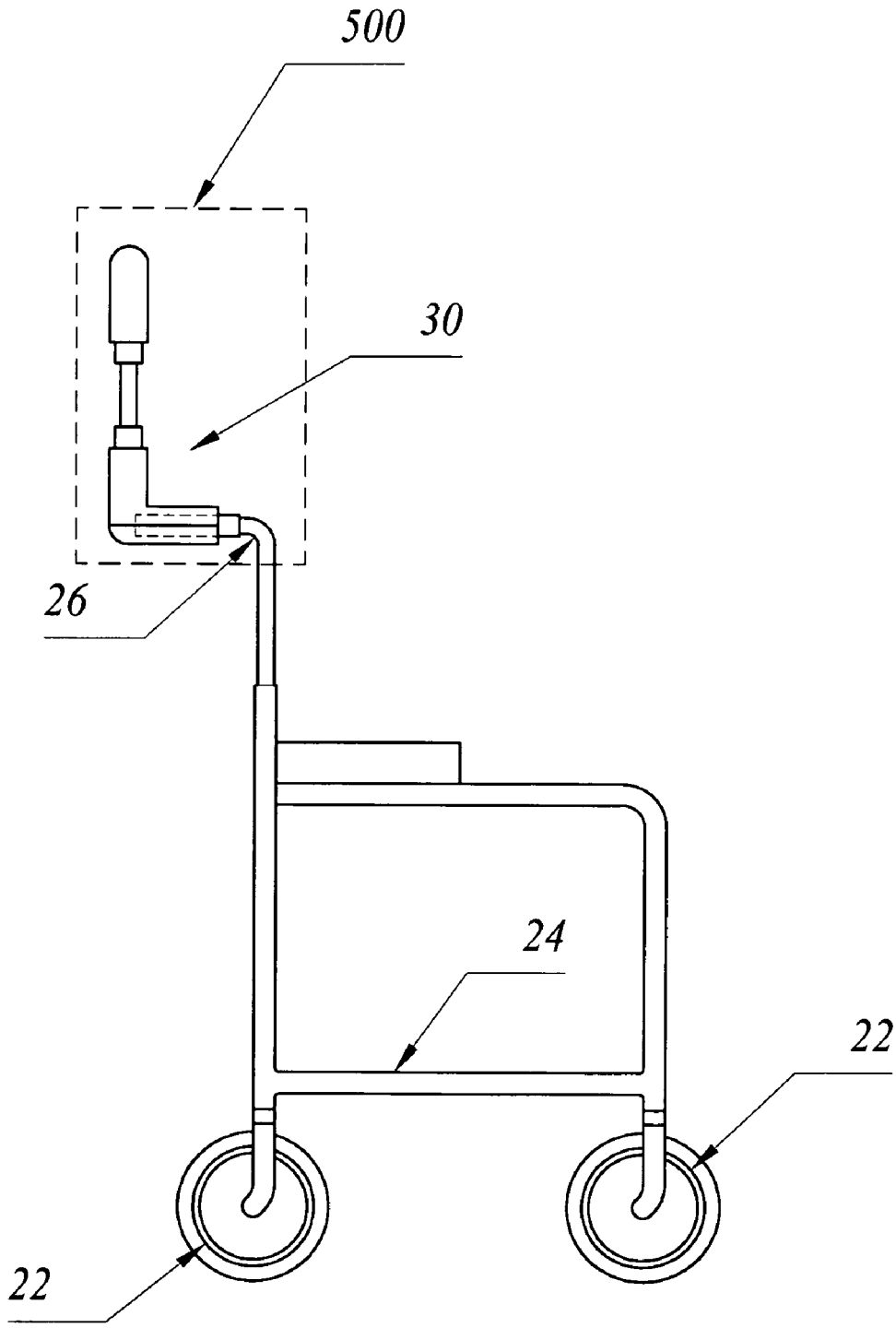
FIG. 2 is a lateral view of the apparatus portrayed in FIG. 1.

FIG. 1 is a rearward depiction of an apparatus (20), i.e., the view of apparatus (20) facing a user of apparatus (20). FIG. 2 is a lateral view of apparatus (20). Among other things, apparatus (20) has wheels (22), frame (24) and handles (26) attached to frame (24). As portrayed in sectional views (400) and (500), extension (30) is connected to handles (26).

Figure 3:
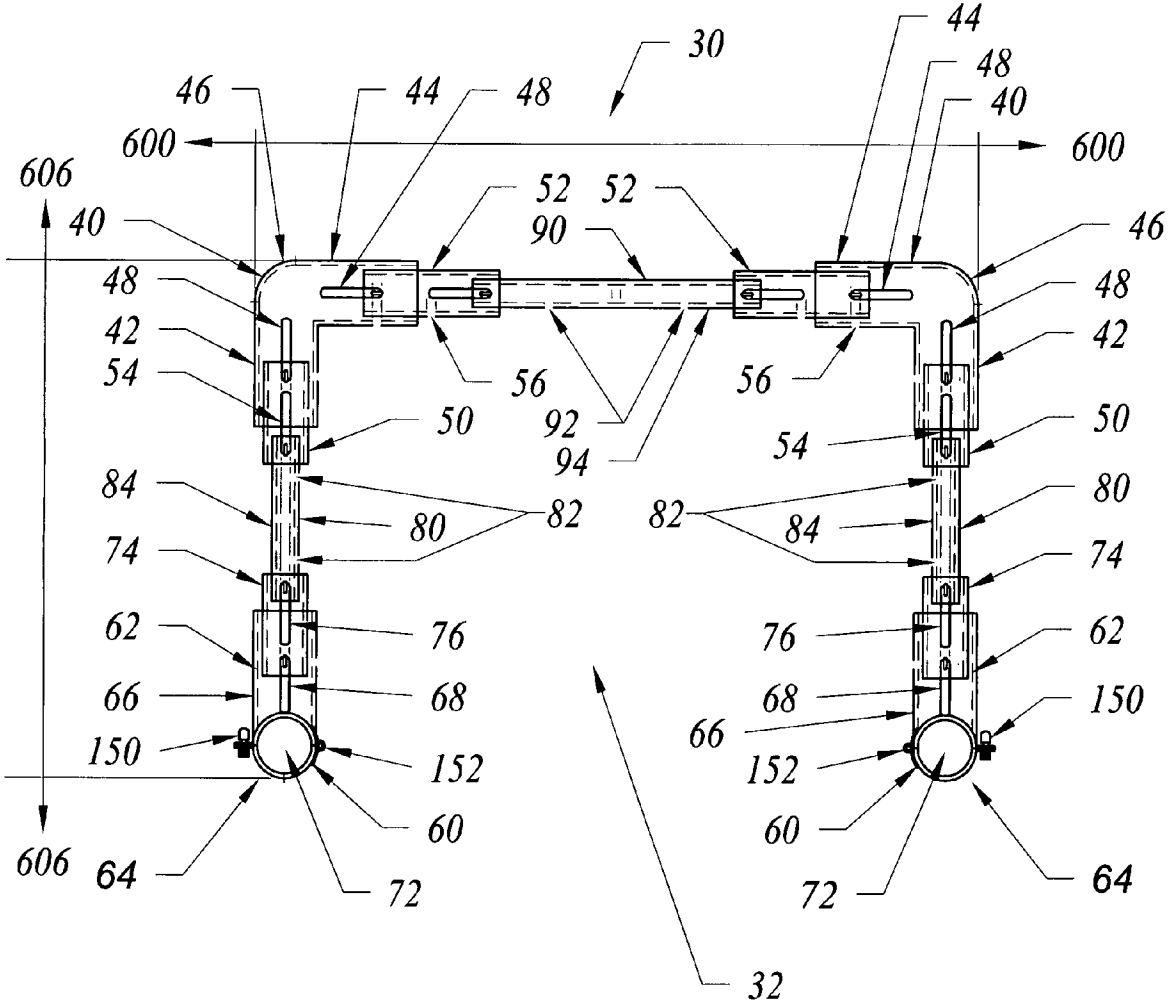
FIG. 3 is a close-up view of extension (30) depicted in section (400) of FIG. 1.
Figure 4:
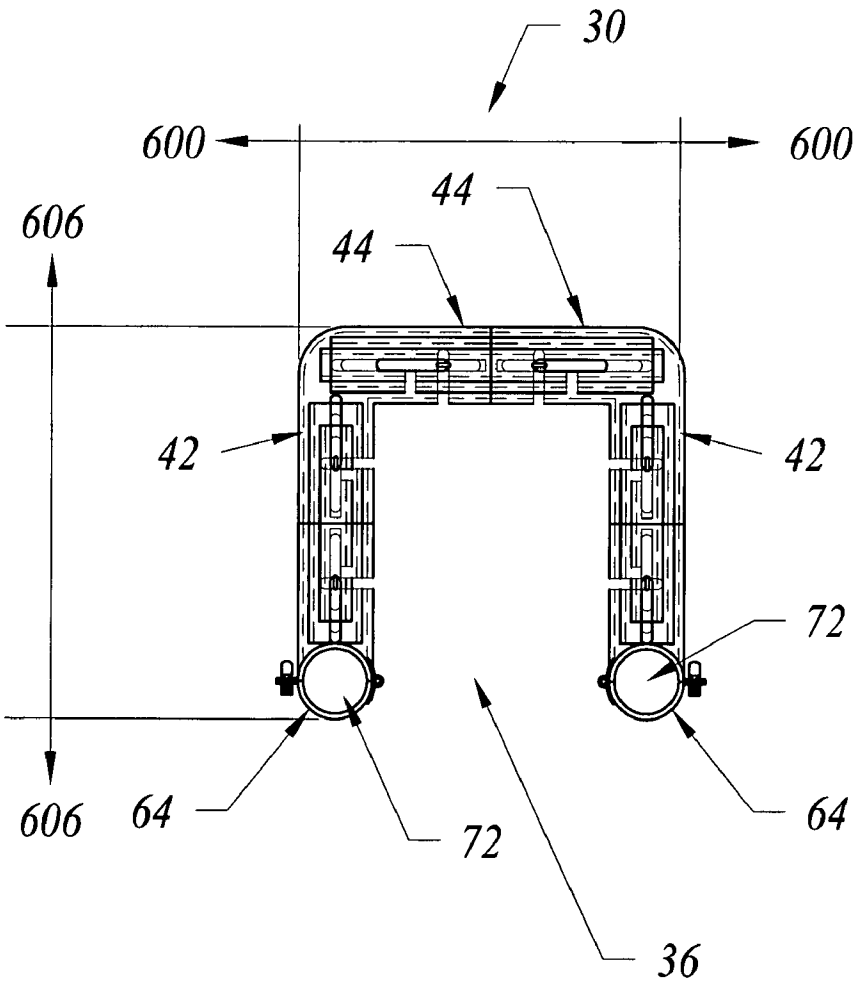
FIG. 4 is a close-up view of extension (30) depicted in section (400) of FIG. 1.

FIGS. 3 and 4 are close-up views of extension (30) depicted in section (400) of FIG. 1. FIG. 3 shows an embodiment of an extension (30) that has been expanded in both the generally vertical and the generally horizontal planes to create a maximal open area (32). FIG. 4 illustrates an embodiment of an extension (30) that has been collapsed to its minimal or closed area (36). Arrows 606-606 depict that extension (30) is adjustable relative to extension's (30) height while arrows 600-600 exemplify that extension (600) is adjustable relative to extension's (30) width. Depending on the structure of the handles to which the extension will be connected, extension (30) can be adjusted to have a maximal area (32), a minimal area (36) or an area between maximal area (32) and minimal area (36).

In select preferred embodiments, extension (30) includes superior angular sleeves or joints (40) and inferior angular sleeves or joints (60). As illustrated in FIGS. 3 and 4, superior hollow elbows (40) are provided with generally vertical members (42) and generally horizontal members (44). In select embodiments, for a single joint (40), general vertical member (42) and general horizontal member (44) form an integral hollow elbow (40). When practicing select embodiments of the current invention, superior elbows (40) can function as handgrips for the user of extension (30).

In select preferred embodiments of the current extension (30), sidewalls (46) of superior angular sleeves (40) include holes or openings (48). Slidable receivers, tubes or rings (50) are securable within generally vertical members (42) and slidable receivers, tubes or rings (52) are securable within generally horizontal members (44). Slidable receivers (50) can include holes or apertures (54) about their circumferential sidewalls. And slidable receivers (52) can also include holes or apertures (56) about their circumferential sidewalls.

In select preferred embodiments of the current extension (30), inferior hollow elbows or angular sleeves (60) have generally vertical members (62) and generally horizontal members or connectors (64). Sidewalls (66) of inferior angular sleeves (60) include openings or holes (68) and connectors (64) include apertures or openings (72). In the practice of the current invention, it has been determined that apertures (72) with diameters of from about 4.2 centimeters to about 4.8 centimeters can be utilized to practice the use of extension (30). Moveable hollow cylinder, tube-like members or receivers (74) are securable within generally vertical members (62). Slidable hollow cylinders (74) can include apertures or openings (76) about slidable hollow cylinders (74) sidewalls.

Generally vertical shafts or shaft-like spans (80) extend between slidable receivers (50) and slidable receivers (74). In select preferred embodiments, generally vertical tube-like members or shafts (80) include openings or apertures (82) about shafts' (80) sidewalls (84). Generally horizontal shaft or shaft-like span (90) extends between slidable receivers (52), and in select embodiments, generally horizontal tube-like member or shaft (90) is provided with openings or apertures (92) about shaft's sidewall (94). Levers (150) and nuts (152) combinations can secure or clamp connectors (64) to handles (not shown in this view).

In the practice of select embodiments of the present invention, the generally horizontal component of extension (30) is adjustable along axis 600-600. It has been discovered that the generally horizontal component can be manufactured such that its minimal length as measured along axis 600-600 is from about 20 centimeters to about 26 centimeters and its maximal length is from about 55 centimeters to about 65 centimeters. The generally horizontal component's minimal length is measured at the point where first and second superior angular sleeves (40) are collapsed to contact each other.

In the practice of select preferred embodiments of the current invention, the generally vertical components of extension (30) are adjustable along axis 606-606. For certain preferred embodiments, it has been discovered that the generally vertical component can be manufactured such that its minimal length as measured along axis 606-606 is from about 20 centimeters to about 26 centimeters and its maximal length is from about 33 centimeters to about 39 centimeters. The generally vertical component's minimal length is measured at the point where generally vertical members (42) of superior hollow elbow (40) are collapsed to contact generally vertical members (62) of inferior hollow elbow (60).

Figure 6:
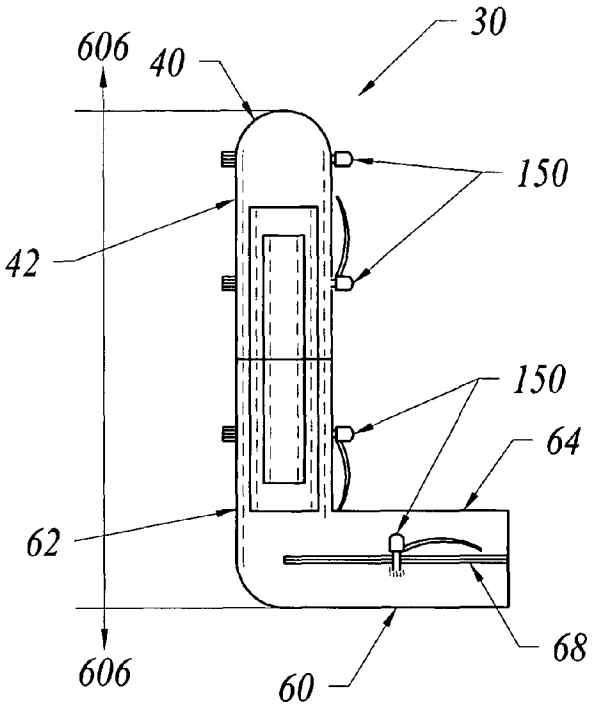
FIG. 6 is a close-up view of extension (30) illustrated in section (500) of FIG. 2.
Figure 5:
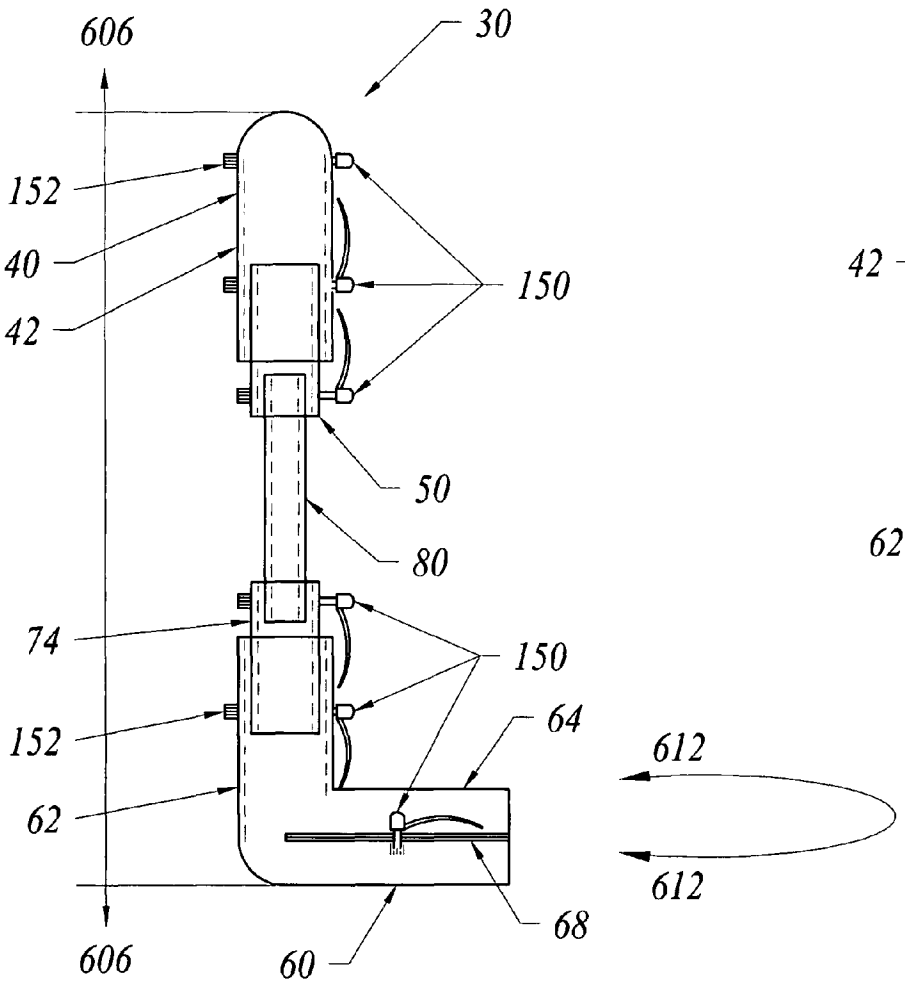
FIG. 5 is a close-up view of extension (30) illustrated in section (500) of FIG. 2.

FIGS. 5 and 6 are close-up views of extension (30) illustrated in section (500) of FIG. 2. FIG. 5 depicts an embodiment of extension (30) that has been maximally expanded in a generally vertical direction along axis 606-606. FIG. 6 portrays an embodiment of extension (30) that is collapsed to its minimal height along axis 606-606.

As shown in FIGS. 5 and 6, shaft-like span (80) extends between slidable receivers (50 and 74). In accord with select preferred embodiments of the present extension (30), lever (150) and nut (152) combinations can secure or clamp: shaft (80) to slidable receiver (50) and slidable receiver (74); slidable ring (50) within generally vertical member (42) of superior elbow (40); hollow cylinder ring (74) within generally vertical member (62) of inferior angular sleeve (60); and connector (64) of joint (60) to a handle. As depicted, lever (150) and nut (152) combinations are quick release clamps. However, other clamping means acceptable in the art can be utilized to securely adjust the height and width of extension (30) to meet the needs of the user.

Among other things, the combination of the fasteners or releasable clamp and nut combinations, generally vertical member's sidewall holes or openings (68), connector's holes or openings (72), movable hollow cylinder's openings or apertures (76) and vertical tube-like member's openings or apertures (82) allow rotation of connector (64) along a generally horizontal path symbolized by arrow 612-612. Horizontal rotation of connectors (64) improves adaptability of extension (30) for use with different types of handles, e.g., handles of a walker can align in one direction while handles of a baby carriage can align in another direction.

Having disclosed the invention as required by Title 35 of the United States Code, Applicants now pray respectfully that Letters Patent be granted for their invention in accordance with the scope of the claims appended hereto.

What is claimed is:

1. An adjustable extension for a pair of handles of a rollable apparatus; said adjustable extension comprising:

a) a first adjustable tubular elbow connector comprising:
  i) an opening at each end thereof;
  ii) a generally horizontal member rotatable through a generally horizontal plane capable of connection to a first handle of said rollable apparatus;
  iii) a generally vertical member integral with said generally horizontal member; and
  iv) one or more holes about a sidewall of said first adjustable elbow connector;

b) a first fastener for securing said first adjustable tubular elbow connector to said first handle;

c) a first generally vertical tubular receiver securable within a vertical member of said first adjustable tubular elbow connector; said first generally vertical tubular receiver comprising one or more openings about a sidewall of said first vertical receiver;

d) a first adjustable tubular elbow handgrip, superior to said first adjustable tubular elbow connector, said first adjustable tubular elbow comprising
  i) an opening at each end thereof;
  ii) a generally vertical member;
  iii) a generally horizontal member integral with said generally vertical member; and
  iv) one or more holes about a sidewall of said first adjustable tubular elbow handgrip;

e) a second generally vertical tubular receiver securable within a vertical member of said first adjustable tubular elbow handgrip; said second generally vertical tubular receiver comprising one or more openings about a sidewall of said second vertical receiver;

f) a first generally horizontal tubular receiver securable within a horizontal member of said first adjustable tubular elbow handgrip; said first generally horizontal tubular receiver comprising one or more openings about a sidewall of said first horizontal receiver;

g) a second adjustable tubular elbow connector comprising:
  i) an opening at each end thereof;
  ii) a generally horizontal member rotatable through a generally horizontal plane capable of connection to a second handle of said rollable apparatus;
  iii) a generally vertical member integral with said first generally horizontal member; and
  iv) one or more holes about a sidewall of said second adjustable tubular elbow connector;

h) a second fastener for securing said second adjustable tubular elbow connector to said second handle;
  i) a third generally vertical tubular receiver securable within a vertical member of said second adjustable tubular elbow connector; said third generally vertical tubular receiver comprising one or more openings about a sidewall of said third vertical tubular receiver;

j) a second adjustable tubular elbow handgrip, superior to said second adjustable tubular elbow connector, said second adjustable tubular elbow comprising:
  i) an opening at each end thereof;
  ii) a generally vertical member;
  iii) a generally horizontal member integral with said generally vertical member; and
  iv) one or more holes about a sidewall of said second adjustable tubular elbow handgrip;

k) a fourth generally vertical tubular receiver securable within a vertical member of said second adjustable tubular elbow handgrip; said fourth generally vertical tubular receiver comprising one or more openings about a sidewall of said fourth vertical tubular receiver;

l) a second generally horizontal tubular receiver securable within a horizontal member of said second adjustable tubular elbow handgrip; said second generally horizontal tubular receiver comprising one or more openings about a sidewall of said second horizontal tubular receiver;

m) a first generally vertical tube member comprising one or more openings about a sidewall of said first vertical tube member; said first generally vertical tube member securable within said first generally vertical tubular receiver and said second generally vertical tubular receiver;

n) a second generally vertical tube member comprising one or more openings about a sidewall of said second vertical tube member; said second generally vertical tube member securable within said third generally vertical tubular receiver and said fourth generally vertical tubular receiver;

o) a generally horizontal tube member comprising one or more openings about a sidewall of said generally horizontal tube member; said generally horizontal tube member securable within said first generally horizontal tubular receiver and said second generally horizontal tubular receiver; and p) a plurality of third fasteners engaging one or more of said holes and said openings for providing secure and selective adjustment of said adjustable extension.

2. The invention of claim 1, wherein said first, said second and said third fasteners are quick release clamps.

3. An extension for a pair of handles, comprising:

a) a first shaft;

b) a second shaft;

c) a third shaft;

d) a first inferior hollow elbow including one or more sidewall openings; said first inferior hollow elbow further comprising: a slidable hollow cylinder insertable into said first inferior hollow elbow and capable of riding along said first shaft, wherein said slidable hollow cylinder further comprises one or more circumferential holes;

e) a second inferior hollow elbow including one or more sidewall openings; said second inferior hollow elbow further comprising: a slidable hollow cylinder insertable into said second end and capable of riding along said second shaft, wherein said slidable hollow cylinder further comprises one or more circumferential holes;

f) fasteners for securing said inferior elbows to said handles;

g) a first superior hollow elbow including one or more sidewall openings; said first superior hollow elbow further comprising:

i) a first slidable ring insertable into a first end and slidable along said first shaft, wherein said first slidable ring further comprises one or more circumferential apertures;

ii) a second slidable ring insertable into a second end and slidable along said third shaft, wherein said second slidable ring further comprises one or more circumferential apertures;

h) a second superior hollow elbow including one or more sidewall openings; said second superior hollow elbow further comprising:

i) a first slidable ring insertable into a first end and slidable along said second shaft, wherein said second slidable ring further comprises one or more circumferential apertures;

ii) a second slidable ring insertable into a second end and slidable along said third shaft, wherein said second slidable ring further comprises one or more circumferential apertures; and i) a plurality of fasteners allowing selective horizontal and vertical adjustment of said extension.

4. The invention of claim 3, wherein said first shaft, said second shaft and said third shaft further comprise circumferential apertures.

5. The invention of claim 4 wherein:

a) a horizontal member of said first inferior hollow elbow is rotatable through a generally horizontal plane; and b) a horizontal member of said second inferior hollow elbow is rotatable through a generally horizontal plane.

6. The invention of claim 5, wherein one or more of said plurality of fasteners engage one or more of said holes, openings and apertures.

7. The invention of claim 6, wherein said fasteners are quick release clamps.

8. An extension for handles, wherein said extension is adjustable relative to said extension's width and height, said extension comprising:

a) a first superior joint comprising first and second receiving ends;

b) a first inferior joint comprising first and second receiving ends;

c) a second superior joint comprising first and second receiving ends;

d) a second inferior joint comprising first and second receiving ends;

e) a first shaft connected with said first receiving end of said first superior joint and said second receiving end of said first inferior joint such that said first superior joint and said first inferior joint are capable of collapsing from an extended position to a contact position or extending from a contact position to an extended position;

f) a second shaft connected with said first receiving end of said second superior joint and said second receiving end of said second inferior joint such that said second superior joint and said second inferior joint are capable of collapsing from an extended position to a contact position or extending from a contact position to an extended position; and g) a third shaft connected with said second receiving end of said first superior joint and said second receiving end of said second superior joint such that said first superior joint and said second superior joint are capable of collapsing from an extended position to a contact position or extending from a contact position to an extended position.

9. The invention of claim 8 further comprising:

a) a slidable receiver secured within each said receiving end of said superior joints; and b) a slidable hollow cylinder secured within one of said receiving ends of said inferior joints.

10. The invention of claim 9 further comprising:

a) one or more apertures about sidewalls of said shaft;

b) one or more openings about sidewalls of:

i) said slidable receivers; and i) said slidable hollow cylinders; and c) one or more holes about sidewalls of said joints.

11. The invention of claim 10 further comprising one or more fasteners engaging one or more of said apertures, said openings and said holes.

12. The invention of claim 11 wherein at least one of said inferior joints comprises a generally horizontal member rotatable through a generally horizontal plane.

13. The invention of claim 11, wherein said fasteners are quick release clamps.

14. The invention of claim 11 wherein each of said inferior joints comprises a generally horizontal member rotatable through a generally horizontal plane.

* * * * *